United States Patent [19]

Brown

[11] Patent Number: 4,820,381

[45] Date of Patent: Apr. 11, 1989

[54] PULP REFINER WITH FLUIDIZING INLET

[75] Inventor: Kenton J. Brown, Mobile, Ala.

[73] Assignee: Internationa Paper Company, Purchase, N.Y.

[21] Appl. No.: 112,326

[22] Filed: Oct. 26, 1987

Related U.S. Application Data

[60] Division of Ser. No. 20,150, Feb. 25, 1987, abandoned, which is a continuation of Ser. No. 770,169, Aug. 28, 1985, abandoned.

[51] Int. Cl.[4] ..... B02C 7/02; B02C 7/06; B02C 13/20; D21D 1/30

[52] U.S. Cl. ..... 162/261; 162/57; 241/245; 241/261.2

[58] Field of Search ..... 162/243, 57, 261, 28, 162/100; 241/163, 28, 261.2, 245

[56] References Cited

U.S. PATENT DOCUMENTS 4,253,613 3/1981 Reinhall ..... 241/28
4,283,016 8/1981 Reinhall ..... 241/28
4,288,288 9/1981 Fleck ..... 162/57
4,339,206 7/1982 Ahs ..... 162/243
4,610,400 9/1986 Sjubom ..... 241/261.2

*Primary Examiner*—Steve Alvo
*Attorney, Agent, or Firm*—Walt Thomas Zielinski

[57] ABSTRACT

A pulp fluidizer and pulp disc refiner apparatus and process. Paper pulp stock of either low (3–8%) or medium (8–15%) fiber consistency is fed from the fluidizer portion of the apparatus to the disc refiner. The construction is such that the outlet of the fluidizer is contiguous to the inlet of the refiner. This geometrical relation permits the de-flocculated pulp from the fluidizer outlet to be fed substantially immediately to the refiner inlet, prior to its naturally occurring reversion to a flocculated state. By providing the input of the disc refiner with de-flocculated paper pulp stock, higher pulp stock consistencies can be worked by the disc refiner, resulting in savings of emergy, equipment and space. Three embodiments of the invention are described.

6 Claims, 3 Drawing Sheets

FIG. 1
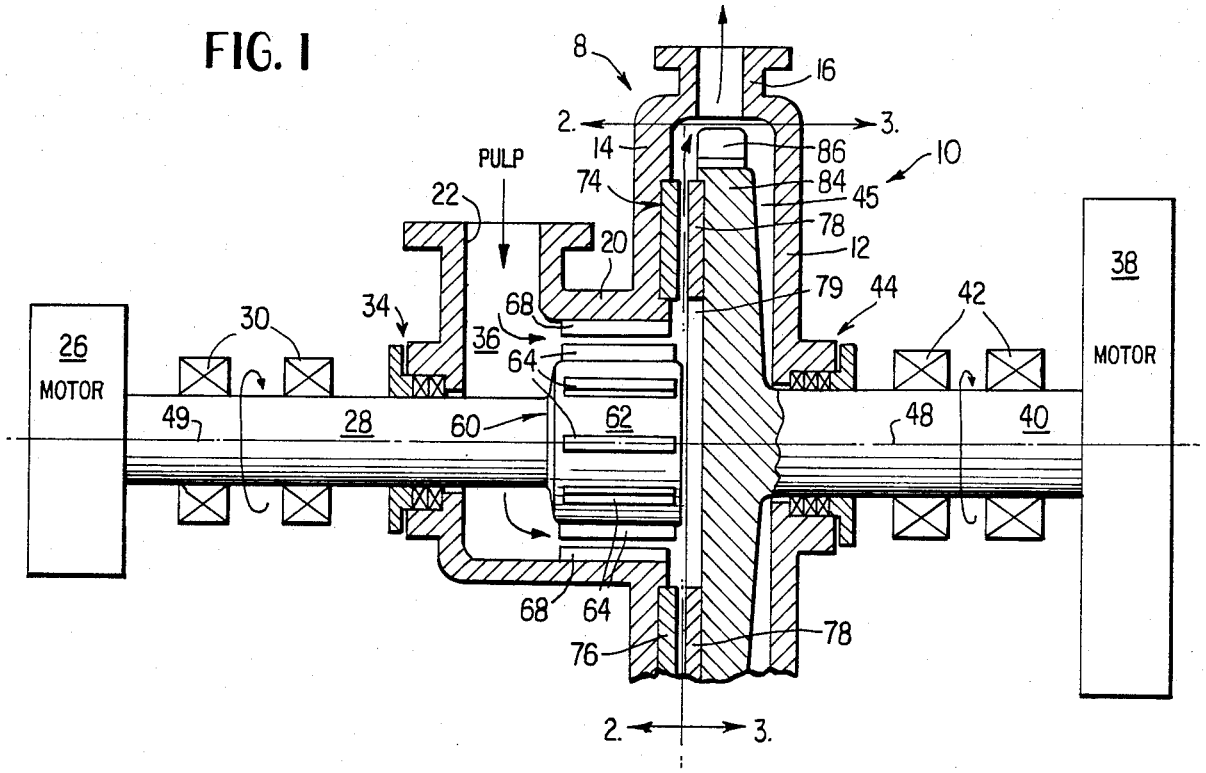
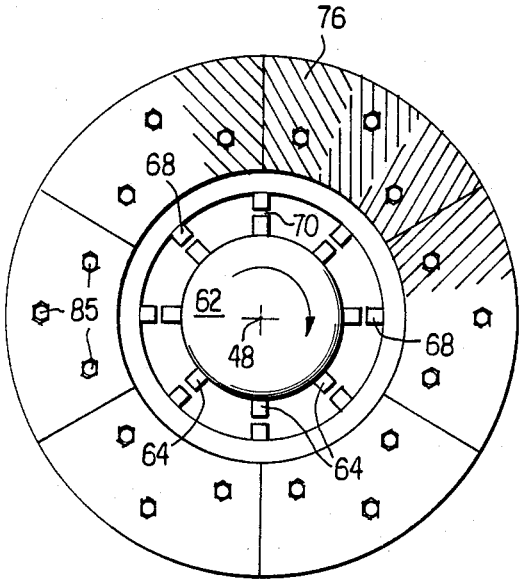
FIG. 2
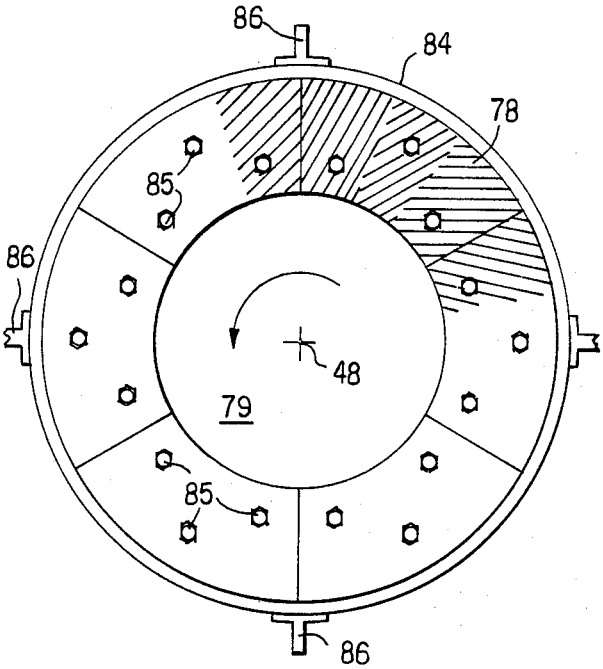
FIG. 3

FIG. 4
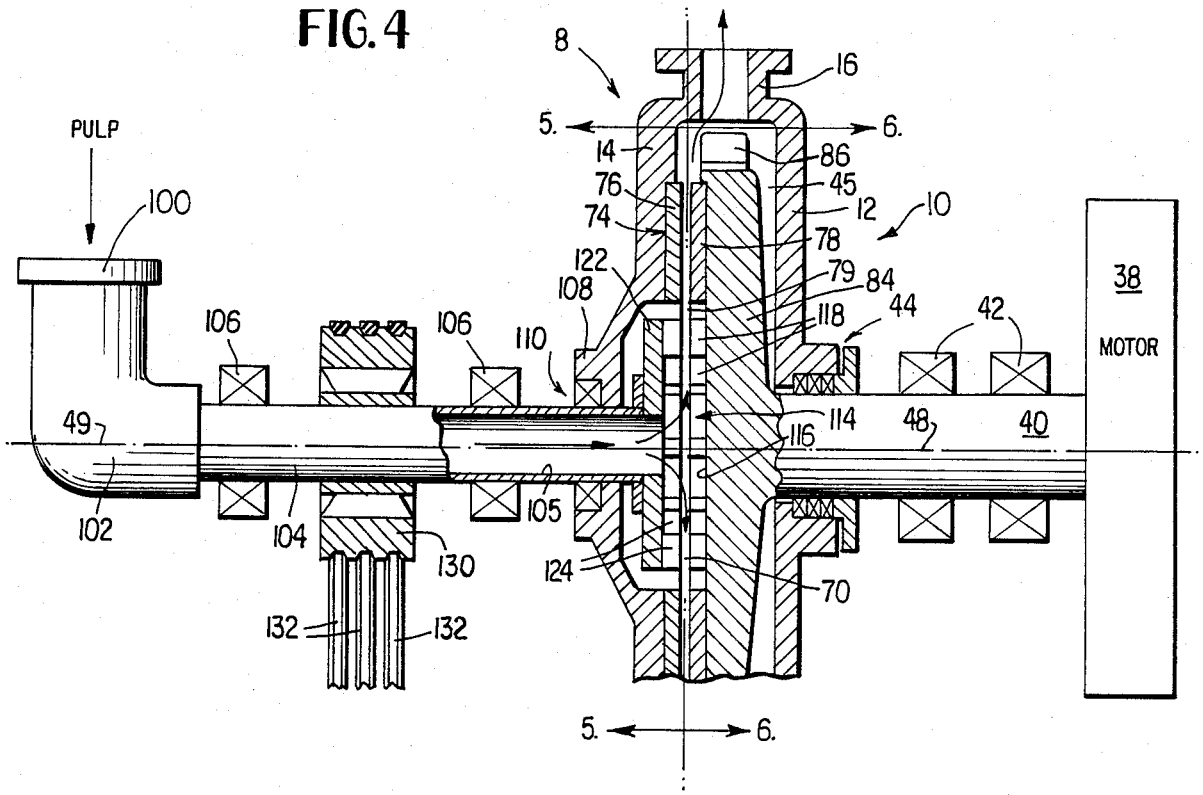
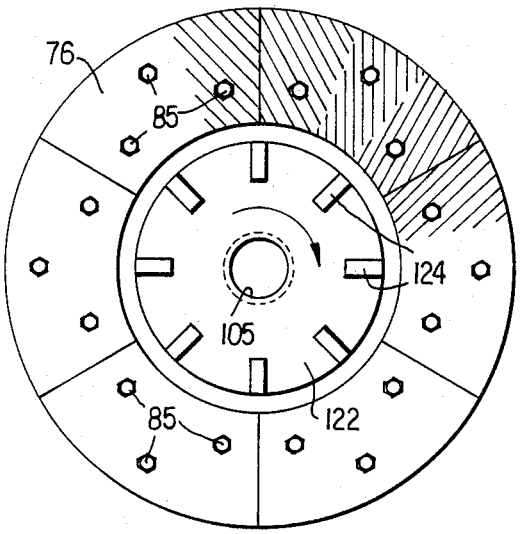
FIG. 5
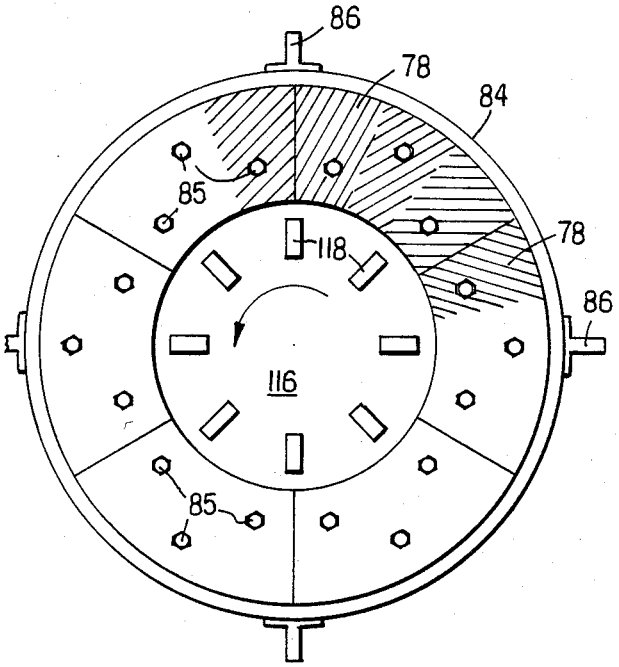
FIG. 6

PULP REFINER WITH FLUIDIZING INLET

This is a division of application Ser. No. 020,150 filed Feb. 25, 1987 now abandoned; which is a File Wrapper continuation of Ser. No. 770,169 filed Aug. 28, 1985, now abandoned.

BACKGROUND OF THE INVENTION

This invention relates to the art of papermaking and more particularly to an apparatus and method of treating paper pulp stock. Paper pulp of relatively low consistency (3 to 8% fiber content) has been fed to a refiner, such as a disc refiner. There, the individual fibers of the pulp stock slurry are cut and/or fractured so as to render the stock suitable for papermaking.

For the purpose of increasing the efficiency of such papermaking operations, it is desirable to treat pulp by a disc refiner having a higher fiber content, such as a fiber content of from 8 to 15%. However, such attempts have usually failed because this higher fiber content results in a jamming or clogging of the disc refiner. Once the refiner commences to clog, finally clogging occurs shortly thereafter with the result that the disc refiner is no longer operable. In attempting to feed medium pulp consistencies to a disc refiner, such as pulp stock having a fiber content of from 8 to 15%, flocculation of the fibers with the slurry causes the above described clogging of the disc refiner.

Prior to this invention, mechanical devices for fluidizing medium consistency paper stock had been known. Such devices include a fluidizing device sold by Kamyr, Inc. under the brand name MC Pump, and is characterized by the seller as a centrifugal, thick-stock pump. This is a rotary device for de-flocculating paper pulp. Such devices have previously been useful, for example, in pumps for pumping paper stock of medium consistency from a storage tank to another portion of the papermaking system. It has been found that medium consistency pulp exhibits high pipe-clogging characteristics and a fluidizer, such as the Kaymr MC Pump, serves to de-flocculate the medium consistency pulp in a pulp storage tank or chest, to thereby enable it to be passed in hydraulic conduits without clogging.

SUMMARY OF THE INVENTION

Prior to this invention, it has not been possible to treat paper stock having a fiber consistency greater than the range of 3 to 8% in a conventional disc refiner. By the practice of this invention, a fluidizer is placed in series with a disc refiner. The action of the fluidizer is to de-flocculate the paper stock of medium consistency (8–15%) so as to provide the input of the disc refiner with de-flocculated stock. It is known, however, that de-flocculated stock, such as stock which has been fluidized as by a Kaymr MC Pump, this being a fluidizing device, will very quickly revert to a flocculated state. To overcome this natural tendency of "decay", i.e., reflocculation, the present apparatus and method is such that substantially immediately after leaving a fluidizer, the medium consistency pulp is passed to the input of a disc refiner. By this arrangement, the disc refiner is substantially free from clogging, even though it is operating on medium consistency pulp stock. In the disc refiner, as is well known, the action is such as to unwind or fibrilate the fibers, as well as splitting them and cutting them. After exiting from the output of the disc refiner of this apparatus, it is believed that the liquid stock will again quickly revert to a flocculated state. However, the action of refining the stock has already taken place and hence such "decay" or re-flocculation has no effect on subsequent pulp operations.

BRIEF DESCRIPTION OF THE DRAWINGS

FIG. 1 is a partial cross-sectional view illustrating the apparatus of this invention according to a first embodiment.

FIG. 2 is a view taken along Section 2—2 of FIG. 1.

FIG. 3 is a view taken along Section 3—3 of FIG. 1.

FIG. 4 is a view similar to FIG. 1 and illustrates a second embodiment of the invention.

FIG. 5 is a view taken along Section 5—5 of FIG. 4.

FIG. 6 is a view taken along Section 6—6 of FIG. 4.

DETAILED DESCRIPTION OF THE INVENTION

Figure 7:
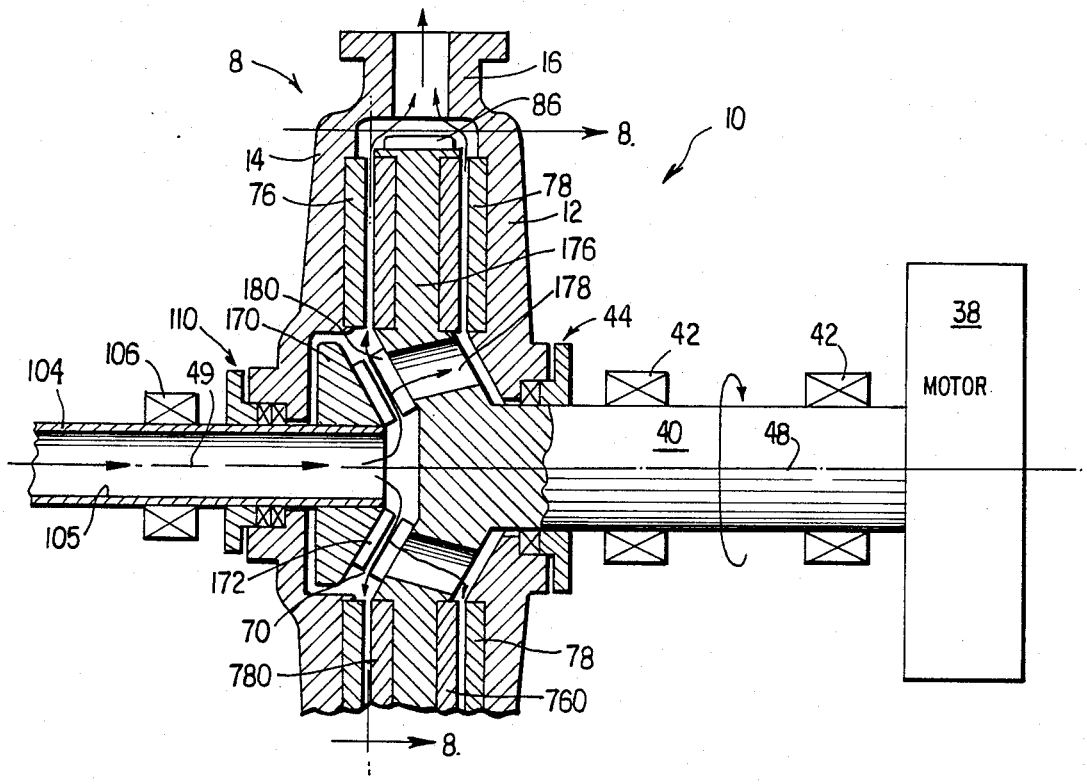
FIG. 7 is a view similar to FIG. 1 and illustrates a third embodiment of the invention.

Turning now to FIGS. 1–3 of the drawings, the numeral 8 denotes generally the apparatus of this invention according to a first embodiment, the apparatus 8 including a hollow casing or housing 10. The numeral 12 denotes one side portion of the generally annular and hollow casing 10, while the numeral 14 denotes the other side. The numeral 16 denotes a single, radially projecting outlet or duct formed in the casing, for carrying away from the apparatus 8 paper pulp stock which is to be treated. The numeral 20 denotes a generally cylindrical tubular portion integral with and adjacent to side 14 of the casing, tubular portion 20 having an inner cylindrical surface. The numeral 22 denotes an inlet nozzle portion, integral with tubular portion 20 of the casing side 14, this inlet portion being adapted to receive liquid pulp stock of medium consistency which is to be treated. The numeral 26 denotes a motor, such as an electric motor, having a speed of, typically, 3600 rpm. The numeral 28 denotes a shaft driven by motor 26, the shaft being supported by rotary bearings denoted schematically by the numeral 30. The curved arrow surrounding shaft 28 denotes a typical direction of rotation of the shaft. The numeral 34 denotes a rotary joint seal between the interior of inlet portion 22 and the exterior of shaft 28, a portion of shaft 28 passing into a pulp inlet chamber 36 of the left portion of the casing.

The numeral 38 denotes a second motor, also typically an electric motor and having a speed of rotation, for example, of 900 rpm. The motor 38 turns shaft 40, the latter being supported by rotary bearings denoted schematically by the numeral 42. The numeral 44 denotes a rotary shaft seal to the interior 45 of the casing and the exterior of shaft 40. The numeral 48 denotes the axis of rotation of shaft 40 while numeral 49 denotes the axis of rotation of shaft 28. The reader will observe that these two axes of rotation are colinear or coaxial.

The numeral 60 denotes generally a pulp fluidizer, partially defined by an enlargement 62 integrally formed on one end of shaft 28, the enlargement 62 having an outer cylindrical surface thereon. The numeral 64 denotes any one of a plurality of angularly spaced bars or other raised portions on the outer cylindrical surface 62, the bars lying in a generally axial direction, parallel to the axis of rotation 49.

The numeral 68 denotes any one of a plurality of similar, also angularly disposed bars, the bars lying on the interior cylindrical surface of portion 20 of the left casing side 14. As shown at FIG. 2, the numeral 70 denotes a radial clearance between corresponding bars 64 and 68. Typically, this clearance is in the order of 0.03–0.05 inches (0.76–1.27 mm). The pulp fluidizer is thus defined by surface 62 with its bars 64 and by the cylindrical surface of portion 20 with its bars 68.

The numeral 74 denotes a disc refiner of generally conventional construction. The disc refiner is defined by a first or left hand disc 76, the disc being defined by a plurality of ridges and grooves on its right hand face which are in opposing relation to similar ridges and grooves on the left hand face of a similar disc denoted by the numeral 78. As shown in FIG. 1, and as is conventional, discs 76 and 78 are apertured, and may be considered as circular disc members each with a central aperture therein. The numeral 79 denotes generally the input zone (annularly continuous) to the disc refiner 74, and the reader will observe that input 79 is contiguous to the right hand edges of bars 64 and 68 of fluidizer 60 and is also in the same general radial plane as the radial plane which contains the right hand ends of bars 64 and 68.

Right hand disc 78 of disc refiner 74 is carried by a radially enlarged portion 84 integral with shaft 40 and at one end of the latter. As seen most clearly at FIGS. 2 and 3, discs 76 and 78 are each defined by, typically, six segments, with each segment being secured to its respective carrier or mounting (14 for segments of disc 76 and 84 for segments of disc 78) by means of bolts or rivets which pass through apertures 84 in the disc segments. Preferably, for a purpose which will later be described, the periphery of enlarged portion 84 of shaft 40 is provided with a plurality of angularly spaced and radially extending blades 86. The function of blades 86 is to wipe a portion of the interior 45 of the casing, as will presently be described.

The operation of the apparatus shown at FIGS. 1–3 will now be described. Paper pulp, such as pulp of medium consistency, is fed into opening 22 of the left hand portion of the casing. Motor 26 turns shaft 28, so that the pulp when entering the left hand or entrance portion of fluidizer 60 will become de-flocculated. This term de-flocculate is intended to refer to the breaking up of lumps of agglomerated or bunched fibers in the paper pulp stock. After passing through fluidizer 60, from left to right as viewed at FIG. 1, the now de-flocculated pulp passes radially outwardly from the exit portion of fluidizer 60 to the input 79 of disc refiner 74. As is conventional with disc refiners, the spacing between the axially projecting ridges of each of the discs is in the order of 0.001 to 0.003 inches (0.025–0.075 mm). The disc refiner operates on the de-flocculated medium consistency paper pulp stock to perform the functions of fibrillation, splitting and cutting, as is conventional in this art. It is believed that after passing radially outwardly from the disc refiner 74, the pulp will very shortly revert or decay to its flocculated state. Such a flocculated state will generally cause clogging and for this purpose blades 86 wipe the radially outermost portion of the interior of the casing to thereby assist in the expulsion of the treated paper stock through the single, radially disposed exit duct 16 of the casing. From this point the paper stock is fed, typically, to a paper machine chest.

It is preferable in the process described that shaft 28 be rotated at a significantly higher speed of rotation than that of shaft 40. Assuming both shafts to rotate in the same, indicated direction, motor 26 would turn at 3600 rpm while motor 38 would turn at 900 rpm. Clearly, the shafts 28 and 40 may turn in opposite directions as well.

Turning now to FIGS. 4, 5 and 6 of the drawings, a second embodiment of the invention will now be described. Those portions of the apparatus which are similar to the embodiment of FIGS. 1–3 bear the same reference numerals, and accordingly a description of them need not be again offered. The numeral 100 denotes a portion of a second casing which is apertured and which receives pulp of medium consistency. The numeral 102 denotes generally a rotor joint housed within this casing, the rotary joint receiving rotary hollow shaft 104, the latter rotating in schematically indicated rotary bearings 106. The numeral 110 denotes a rotary seal for sealing the exterior of shaft 105 from the interior of the casing. The numeral 114 denotes generally a fluidizer of a second construction, the fluidizer including first and second hub elements. The numeral 122 denotes a first hub member in the form of a centrally apertured disc, carried by and fixedly secured to the exit (right) end of hollow shaft 104. The right face of hub 122 is provided with a plurality of radially oriented, uniformly angularly spaced bar protuberances 124. The numeral 116 denotes a second hub member, opposite to the first hub 122, and also carrying a plurality of radially oriented, uniformly angularly spaced bar protuberances 118. Hub member 116 is an integral portion of radially enlarged portion 84 of rotary shaft 40. The axial spacing between corresponding protuberances 118 and 124 is substantially the same as the radial spacing of bars 64 and 68 of the embodiment of FIGS. 1–3. The numeral 130 denotes a grooved pulley which is, in any conventional manner, fixedly secured to the exterior of rotary, hollow shaft 104 and is rotated by a plurality of belts 132 which are in turn driven by a motor, such as an electric motor, not illustrated.

The mode of operation of this second embodiment is as follows. Medium consistency pulp containing flocculations is fed into the inlet 100 and passes to rotary joint 102 where it then passes through the interior of hollow shaft 104 which rotates about axis 49. The shaft 104 is caused to rotate by pulley 130 rotated by belts 132. At the same time, the other motor 38 is rotating shaft 40 to operate the disc refiner 74, the latter being of the same construction as that previously described. Again, a typical speed of rotation of shaft 104 would be 3600 rpm, while a typical speed of rotation of motor 38 would be 900 rpm, with the shafts being rotated in the indicated direction shown by the curved arrows. Upon exiting from the right hand portion of hollow shaft 104, the deflocculated, medium consistency pulp flows radially outwardly and between the protuberances 118, 124 of fluidizer 114. After passing through the fluidizer the now deflocculated pulp passes radially outwardly to the same annularly continuous inlet 79 of disc refiner 74 as that previously described. The action from this point on is the same as that previously described.

Figure 8:
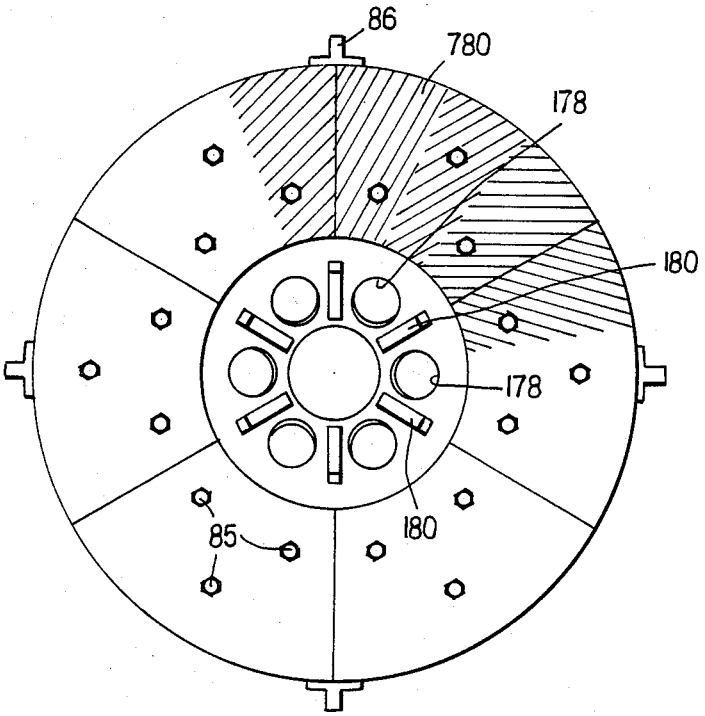
FIG. 8 is a view taken along Section 7—7 of FIG. 7.

Referring now to FIGS. 7 and 8, a third embodiment of the invention will now be described. Certain elements of this third embodiment are similar to those of the embodiment of FIGS.4–6. At FIG. 7, hollow shaft 104 having a bore 105 is rotated, as by an arrangement such as pulley 130 of FIG. 4. Paper pulp stock to be fluidized, i.e., de-flocculated, is fed from left to right through bore 105. Numeral 170 represents a hub or disc element which is centrally apertured and which fixedly receives the right hand end of shaft 104. The right hand face of hub 170 is provided with a plurality of spaced and annularly continuous protuberances 172, again in the form of radially positioned bars.

The numeral 176 denotes the left end of shaft 40, driven by motor 38, portion 176 being radially enlarged and integral with shaft 40. Numeral 178 denotes any one of a plurality of uniformly annularly space through passage ports extending from the left to the right radial face of enlargement 176, the ports are slanted slightly radially outwardly and are spaced relatively close to the axis of rotation 48. The numeral 180 denotes a plurality uniformly annularly spaced protuberances, again in the form of bars, bars 180 being fixed to the left face of radial enlargement 176 at the same general radial location as ports 178. As may be seen by reference to FIG. 8, ports 178 are angularly spaced with the radially disposed bars 180.

The embodiment of FIG. 4 of this invention utilizes a so-called single disc refiner. Most of those disc refiners which are currently in vogue employ a double disc. The embodiment of FIG. 7 is thus similar to the embodiment of FIG. 4 except that in FIG. 7 a double-disc refiner is illustrated. Again, the numeral 76 denotes a left hand segmented disc fixed and mounted in left hand casing portion 14, while the numeral 78 denotes a corresponding right hand segmented disc fixedly positioned and carried by right hand casing portion 12. The numeral 780 denotes the disc which cooperates with disc 76, while the numeral 760 denotes the disc which cooperates with disc 78. Each of the disc pairs illustrated is of a construction identical with discs 76, 78 which have been previously described.

The mode of operation of this third embodiment of the invention is as follows. Paper pulp stock fed into the bore 105 by an arrangement such as shown in FIG. 4 exits from the right hand end of hollow shaft 104 and passes radially outwardly to the radially innermost portions of relatively rotating bars 172, 180. Again, the clearance between the bars is indicated by the numeral 70 and is of the same order of magnitude as that previously described with respect to the embodiments of FIGS. 1 and 4. One portion of the treated paper stock which is fluidized by relatively rotating bars 172, 180 passes up through the left portion of the casing 10 to the first disc refiner, while a second portion of the fluidized paper stock pulp passes axially to the right through ports 178 and to the inlet of the second disc refiner. The radially outermost outputs from the two disc refiners then combine to flow from casing 10 radially outwardly through duct 16 to again typically, a paper machine chest. Again, one or more wiping blades 86 is affixed to the radially outermost portion of the disc refiners to assist in the prevention of clogging on the interior of the casing which might be caused by re-flocculation.

I claim:

1. A pulp refiner and pulp fluidizing apparatus for the treatment of paper pulp stock, the apparatus including a rotary pulp refiner and a rotary pulp fluidizer housed within a casing, at least a portion of the fluidizer being connected to and rotatable by a first shaft, at least a portion of the refiner being connected to and rotatable by a second shaft, said first and second shafts being coaxial to define a common axis and are rotatable independently of each other, whereby the fluidizer can be operated at a greater rotary speed than the rotary speed of the refiner, the output of the fluidizer being positioned contiguously to the input of the refiner, whereby the fluidizer deflocculates the paper pulp stock and the deflocculated stock substantially immediately passes to the input of the refiner while it is still deflocculated, whereby clogging of the refiner is inhibited and therefore higher paper pulp stock consistency can be refined by the disc refiner without clogging, and wherein the fluidizer is defined by said first rotary shaft carrying a cylindrical member having angularly spaced raised portions on its exterior cylindrical surface, and by a stationary cylindrical member carried by the casing and having angularly spaced raised portions uniformly on its interior, cylindrical surface, the two said cylindrical surfaces being coaxial and the raised portions of each radially spaced from each other, the paper pulp stock being adapted to be fed to one axial end of the two cylindrical surfaces, and adapted to pass from the other axial end of the two cylindrical surfaces, said other axial end of the two cylindrical surfaces being positioned contiguously to the input of the refiner, the rotary speed of the fluidizer being completely independent of the rotary speed of the refiner and wherein said other axial end of the said two fluidizer cylindrical surfaces lies substantially in a radial plane which is at right angles to said common axis, and wherein the input zone to the pulp refiner lies substantially in said radial plane, the refiner being of the disc type having ridges and wherein the radial spacing between the raised portions of said cylindrical surfaces of said fluidizer is uniform and is greater than the spacing between the opposed ridges of the refiner.

2. The apparatus of claim 1 wherein one rotary disc of the disc refiner is carried by a radially enlarged portion of said second shaft and including a wiping blade carried by said radially enlarged portion to thereby inhibit clogging of the interior of the casing.

3. The apparatus of claim 2 wherein the passage ports of the second rotary hub are interpositioned between the fluidizer raised portions carried by the second hub.

4. A pulp refiner and pulp fluidizing apparatus for the treatment of paper pulp stock, the apparatus including a rotary pulp refiner and a rotary pulp fluidizer housed within a casing, at least a portion of the fluidizer being connected to and rotatable by a first shaft, at least a portion of the refiner being connected to and rotatable by a second shaft, said first and second shafts being coaxial to define a common axis and are rotatable independently of each other, whereby the fluidizer can be operated at a greater rotary speed than the rotary speed of the refiner, the output of the fluidizer being positioned contiguously to the input of the refiner, whereby the fluidizer deflocculates the paper pulp stock and the deflocculated stock substantially immediately passes to the input of the refiner while it is still deflocculated, whereby clogging of the refiner is inhibited and therefore higher paper pulp stock consistency can be refined by the disc refiner without clogging, and wherein the fluidizer includes a first rotary hub driven by a hollow, rotary drive member, the latter being said first shaft, the first rotary hub being centrally apertured and receiving one end of the hollow rotary drive member, the hollow drive member adapted to carry paper pulp stock, the fluidizer also including a second rotary hub generally parallel to and axially spaced from said first rotary hub and rotated by said second shaft, at least a portion of the opposing faces of said fluidizer hubs each carrying angularly spaced raised portions, the raised portions of the two hubs being spaced from each other during relative rotation of the first and second hubs, the refiner being of the disc type having opposed ridges, the spacing between the opposed raised portions of the fluidizer hubs being greater than the spacing between the opposed ridges of the refiner.

5. The apparatus of claim 4 wherein one rotary disc of the disc refiner is carried by a radially enlarged portion of said second shaft, and including a wiping blade carried by said radially enlarged portion to thereby inhibit clogging of the interior of the casing.

6. The apparatus of claim 4 wherein the raised portions of each of the two rotary hub members lie in parallel planes, each plane being substantially at right angles to said common axis of rotation.

* * * * *